US010905918B2

(12) United States Patent
Kimura et al.

(10) Patent No.: US 10,905,918 B2
(45) Date of Patent: Feb. 2, 2021

(54) GOLF BALL

(71) Applicant: Bridgestone Sports Co., Ltd., Tokyo (JP)

(72) Inventors: Akira Kimura, Saitamaken (JP); Katsunobu Mochizuki, Saitamaken (JP); Masahiro Yamabe, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 16/690,304

(22) Filed: Nov. 21, 2019

(65) Prior Publication Data

US 2020/0179766 A1 Jun. 11, 2020

(30) Foreign Application Priority Data

Dec. 7, 2018 (JP) ..... 2018-229979

(51) Int. Cl.
*A63B 37/06* (2006.01)
*A63B 37/00* (2006.01)

(52) U.S. Cl.
CPC ..... *A63B 37/0075* (2013.01); *A63B 37/0012* (2013.01); *A63B 37/0021* (2013.01); *A63B 37/0031* (2013.01); *A63B 37/0035* (2013.01); *A63B 37/0039* (2013.01); *A63B 37/0084* (2013.01); *A63B 37/0092* (2013.01)

(58) Field of Classification Search
CPC ..... A63B 37/0024; A63B 37/0023; A63B 37/0012
USPC ..... 473/378
See application file for complete search history.

(56) References Cited

U.S. PATENT DOCUMENTS 6,319,152 B1 * 11/2001 Takesue ..... A63B 37/0003 473/365
6,939,924 B2 * 9/2005 Kim ..... C08F 283/006 473/354
2012/0220391 A1 * 8/2012 Sullivan ..... A63B 37/0003 473/376
2016/0184652 A1 6/2016 Nanba
2017/0182367 A1 6/2017 Nanba

FOREIGN PATENT DOCUMENTS

JP 4754328 * 8/2011
JP 2016-119946 A 7/2016
JP 2017-113220 A 6/2017

* cited by examiner

*Primary Examiner* — Raeann Gorden
(74) *Attorney, Agent, or Firm* — Sughrue Mion, PLLC

(57) ABSTRACT

A golf ball having a core and a cover that is formed of a resin composition which includes (A) a polyurethane or a polyurea and (B) a styrenic resin material, when dropped from a height of 3 m and made to collide with a metal plate, has velocities 200 ms before and 200 ms after contact that satisfy the condition: (incident velocity)−(rebound velocity)≥0.80 m/s. The ball has a good controllability on approach shots without a loss in the distance achieved on shots with a driver, and thus is particularly useful to professional golfers and skilled amateurs.

8 Claims, 2 Drawing Sheets

GOLF BALL

CROSS-REFERENCE TO RELATED APPLICATION

This non-provisional application claims priority under 35 U.S.C. § 119(a) on Patent Application No. 2018-229979 filed in Japan on Dec. 7, 2018, the entire contents of which are hereby incorporated by reference.

TECHNICAL FIELD

The present invention relates to a multilayer golf ball of two or more pieces that has a core and a cover, which golf ball has a good controllability on approach shots without sacrificing distance on shots with a driver.

BACKGROUND ART

The chief characteristic demanded of golf balls is an increased distance, although other desired properties include the ability of the ball to stop well on approach shots and scuff resistance. Many golf balls endowed with a good flight on shots with a driver and a good receptivity to backspin on approach shots have hitherto been developed. In addition, golf ball cover materials possessing a high resilience and a good scuff resistance have been developed.

Today, urethane resin materials are often used in place of ionomeric resin materials as the cover material, especially in golf balls for professional golfers and skilled amateur golfers. However, professional golfers and skilled amateur golfers desire golf balls having even better controllability on approach shots, and so further improvement is sought even among cover materials in which a urethane resin material serves as the base resin. JP-A 2017-113220 discloses, as a cover material that endows the ball with excellent controllability around the green when played with a short iron such as a sand wedge and that can also extend the distance traveled by the ball on shots with a driver, a golf ball resin material which includes a specific styrenic thermoplastic elastomer and a thermoplastic resin having on the molecule either styrene monomer units or diene monomer units. Also, JP-A 2016-119946 discloses a resin material for golf balls that is composed primarily of a styrene-butadiene-styrene block copolymer and provides the ball with excellent controllability when hit around the green with a short iron such as a sand wedge.

However, although such golf ball resin materials do provide the ball with a high spin rate on approach shots and a good controllability, in some cases the ball velocity on approach shots is more rapid and the ball separates too readily from the club upon impact. Accordingly, there exists a desire to increase the controllability on approach shots even further than in the golf balls that have hitherto been disclosed in the art.

SUMMARY OF THE INVENTION

It is therefore an object of the present invention to provide a golf ball which has a good controllability on approach shots without a loss in the distance achieved on shots with a driver.

As a result of extensive investigations, we have discovered that by using, as the cover material in golf balls having a core and a cover, a resin composition containing (A) a polyurethane or a polyurea and (B) a styrenic resin material and producing golf balls which, on measurement of the ball velocity 200 ms before and 200 ms after contact when the ball is dropped from a height of 3 m and made to collide with a metal plate, satisfy formula (1) below $$\text{(incident velocity)}-\text{(rebound velocity)} \geq 0.80 \text{ m/s} \quad (1),$$

the golf balls have a good controllability on approach shots and provide golfers with a competitive edge.

Accordingly, the invention provides a golf ball having a core and a cover, wherein the cover is formed of a resin composition that includes (A) a polyurethane or a polyurea and (B) a styrenic resin material. The ball, when dropped from a height of 3 m and made to collide with a metal plate, has velocities 200 ms before and 200 ms after contact that satisfy formula (1) below $$\text{(incident velocity)}-\text{(rebound velocity)} \geq 0.80 \text{ m/s} \quad (1).$$

In a preferred embodiment of the golf ball of the invention, the resin composition of the cover has a component (B) content of from 0.5 to 50 parts by weight per 100 parts by weight of component (A).

In another preferred embodiment of the inventive golf ball, component (B) is one or more selected from the group consisting of polystyrene (PS), general-purpose polystyrene resins (GPPS), high-impact polystyrene resins (HIPS), styrene-isoprene-styrene block copolymers (SIS), styrene-butadiene-styrene block copolymers (SBS), styrene-ethylene/butadiene-styrene block copolymers (SEBS), styrene-ethylene/isoprene-styrene block copolymers (SEPS), acrylonitrile/styrene copolymers (AS), acrylonitrile/ethylene-propylene-unconjugated diene rubber/styrene copolymers (AES), acrylonitrile/butadiene/styrene copolymers (ABS), methyl methacrylate/butadiene/styrene copolymers (MBS) and acrylonitrile/styrene/acrylic rubber copolymers (ASA).

Component (B) is more preferably a high-impact polystyrene resin (HIPS).

In yet another preferred embodiment, when the ball is struck at a head speed (HS) of 21 m/s using a wedge with a loft angle of 58° that is mounted on a shot robot made by Miyamae Co., Ltd., the relationship between the head speed (HS) and the ball initial velocity (IV) satisfies the condition $$HS-IV \geq 0.26 \text{ (m/s)}.$$

In a further preferred embodiment, the cover has a Martens hardness (Hm), as measured at a position 0.2 mm toward a center of the ball from a surface of the cover, which is 25 $N/mm^2$ or less. The Martens hardness (Hm) is more preferably from 10 to 20 $N/mm^2$.

In a still further preferred embodiment, the golf ball has at least one intermediate layer interposed between the core and the cover, which intermediate layer is made of a material that includes a high-acid ionomeric resin having an acid content of at least 16 wt %.

In a yet further preferred embodiment, the cover has a plurality of dimples formed on a surface thereof, the ball has arranged thereon at least one dimple with a cross-sectional shape that is described by a curved line or a combination of straight and curved lines and specified by steps (i) to (iv) below, and the total number of dimples is from 250 to 380:

(i) letting the foot of a perpendicular drawn from a deepest point of the dimple to an imaginary plane defined by a peripheral edge of the dimple be the dimple center and a straight line that passes through the dimple center and any one point on the edge of the dimple be the reference line;

(ii) dividing a segment of the reference line from the dimple edge to the dimple center into at least 100 points and computing the distance ratio for each point when the distance from the dimple edge to the dimple center is set to 100%;

(iii) computing the dimple depth ratio at every 20% from 0 to 100% of the distance from the dimple edge to the dimple center; and (iv) at the depth ratios in dimple regions 20 to 100% of the distance from the dimple edge to the dimple center, determining the change in depth ΔH every 20% of said distance and designing a dimple cross-sectional shape such that the change ΔH is at least 6% and not more than 24% in all regions corresponding to from 20 to 100% of said distance.

Advantageous Effects of the Invention

The golf ball of the invention has both an optimized spin rate and a low initial velocity on approach shots, and thus possesses a very high controllability on approach shots, without a loss in the distance achieved on shots with a driver. These qualities make it useful particularly to professional golfers and skilled amateurs.

BRIEF DESCRIPTION OF THE DIAGRAMS

DESCRIPTION OF THE PREFERRED EMBODIMENTS

Figure 1:
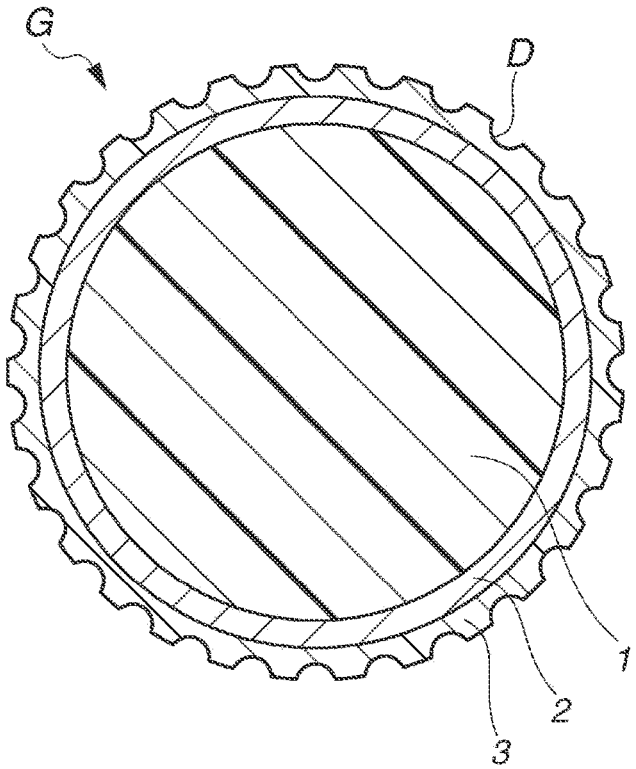
FIG. 1 is a schematic cross-sectional view of a multi-piece solid golf ball according to an embodiment of the invention.

The objects, features and advantages of the invention will become more apparent from the following detailed description taken in conjunction with the appended diagrams.

The golf ball of the invention has a core and a cover.

The core may be formed using a known rubber material as the base material. Known base rubbers, such as natural rubber or synthetic rubber, may be used as the base rubber. More specifically, the use of polybutadiene, especially cis-1,4-polybutadiene having a cis structure content of at least 40%, is recommended. If desired, natural rubber, polyisoprene rubber, styrene-butadiene rubber or the like may be used together with the foregoing polybutadiene in the base rubber.

The polybutadiene may be synthesized with a metal catalyst, such as a neodymium or other rare-earth catalyst, a cobalt catalyst or a nickel catalyst.

Co-crosslinking agents such as unsaturated carboxylic acids and metal salts thereof, inorganic fillers such as zinc oxide, barium sulfate and calcium carbonate, and organic peroxides such as dicumyl peroxide and 1,1-bis(t-butylperoxy)cyclohexane may be included in the base rubber. If necessary, commercial antioxidants and the like may also be suitably added.

In this invention, the cover is formed of a resin composition containing (A) a polyurethane or a polyurea, and (B) a styrenic resin material.

Component (A) is a polyurethane or a polyurea. Details on these are given below.

Polyurethane

The polyurethane has a structure which includes soft segments composed of a polymeric polyol (polymeric glycol) that is a long-chain polyol, and hard segments composed of a chain extender and a polyisocyanate. Here, the polymeric polyol serving as a starting material may be any that has hitherto been used in the art relating to polyurethane materials, and is not particularly limited. This is exemplified by polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. Specific examples of polyester polyols that may be used include adipate-type polyols such as polyethylene adipate glycol, polypropylene adipate glycol, polybutadiene adipate glycol and polyhexamethylene adipate glycol; and lactone-type polyols such as polycaprolactone polyol. Examples of polyether polyols include poly(ethylene glycol), poly(propylene glycol), poly(tetramethylene glycol) and poly(methyltetramethylene glycol). Such long-chain polyols may be used singly, or two or more may be used in combination.

The long-chain polyol preferably has a number-average molecular weight in the range of 1,000 to 5,000. By using a long-chain polyol having a number-average molecular weight in this range, golf balls made with a polyurethane composition that have excellent properties, including a good rebound and a good productivity, can be reliably obtained. The number-average molecular weight of the long-chain polyol is more preferably in the range of 1,500 to 4,000, and even more preferably in the range of 1,700 to 3,500.

Here and below, "number-average molecular weight" refers to the number-average molecular weight calculated based on the hydroxyl value measured in accordance with JIS-K1557.

The chain extender is not particularly limited; any chain extender that has hitherto been employed in the art relating to polyurethanes may be suitably used. In this invention, low-molecular-weight compounds with a molecular weight of 2,000 or less which have on the molecule two or more active hydrogen atoms capable of reacting with isocyanate groups may be used. Of these, preferred use can be made of aliphatic diols having from 2 to 12 carbon atoms. Specific examples include 1,4-butylene glycol, 1,2-ethylene glycol, 1,3-butanediol, 1,6-hexanediol and 2,2-dimethyl-1,3-propanediol. Of these, the use of 1,4-butylene glycol is especially preferred.

Any polyisocyanate hitherto employed in the art relating to polyurethanes may be suitably used without particular limitation as the polyisocyanate. For example, use can be made of one or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate, 1,4-bis(isocyanatomethyl)cyclohexane and dimer acid diisocyanate. However, depending on the type of isocyanate, crosslinking reactions during injection molding may be difficult to control.

The ratio of active hydrogen atoms to isocyanate groups in the polyurethane-forming reaction may be suitably adjusted within a preferred range. Specifically, in preparing a polyurethane by reacting the above long-chain polyol, polyisocyanate and chain extender, it is preferable to use the respective components in proportions such that the amount of isocyanate groups included in the polyisocyanate per mole of active hydrogen atoms on the long-chain polyol and the chain extender is from 0.95 to 1.05 moles.

The method of preparing the polyurethane is not particularly limited. Preparation using the long-chain polyol, chain extender and polyisocyanate may be carried out by either a prepolymer process or a one-shot process via a known urethane-forming reaction. Of these, melt polymerization in the substantial absence of solvent is preferred. Production by continuous melt polymerization using a multiple screw extruder is especially preferred.

It is preferable to use a thermoplastic polyurethane material as the polyurethane. The thermoplastic polyurethane material may be a commercial product, examples of which include those available under the trade name Pandex from DIC Covestro Polymer, Ltd., and those available under the trade name Resamine from Dainichiseika Color & Chemicals Mfg. Co., Ltd.

Polyurea

The polyurea is a resin composition composed primarily of urea linkages formed by reacting (i) an isocyanate with (ii) an amine-terminated compound. This resin composition is described in detail below.

(i) Isocyanate

The isocyanate is preferably one that is used in the prior art relating to polyurethanes, but is not particularly limited. Use may be made of isocyanates similar to those mentioned above in connection with the polyurethane material.

(ii) Amine-Terminated Compound

An amine-terminated compound is a compound having an amino group at the end of the molecular chain. In this invention, the long-chain polyamines and/or amine curing agents shown below may be used.

A long-chain polyamine is an amine compound which has on the molecule at least two amino groups capable of reacting with isocyanate groups, and which has a number-average molecular weight of from 1,000 to 5,000. In this invention, the number-average molecular weight is more preferably from 1,500 to 4,000, and even more preferably from 1,900 to 3,000. Examples of such long-chain polyamines include, but are not limited to, amine-terminated hydrocarbons, amine-terminated polyethers, amine-terminated polyesters, amine-terminated polycarbonates, amine-terminated polycaprolactones, and mixtures thereof. These long-chain polyamines may be used singly, or two or more may be used in combination.

An amine curing agent is an amine compound which has on the molecule at least two amino groups capable of reacting with isocyanate groups, and which has a number-average molecular weight of less than 1,000. In this invention, the number-average molecular weight is more preferably less than 800, and even more preferably less than 600. Specific examples of such amine curing agents include, but are not limited to, ethylenediamine, hexamethylenediamine, 1-methyl-2,6-cyclohexyldiamine, tetrahydroxypropylene ethylenediamine, 2,2,4- and 2,4,4-trimethyl-1,6-hexanediamine, 4,4'-bis(sec-butylamino)dicyclohexylmethane, 1,4-bis(sec-butylamino)cyclohexane, 1,2-bis(sec-butylamino) cyclohexane, derivatives of 4,4'-bis(sec-butylamino) dicyclohexylmethane, 4,4'-dicyclohexylmethanediamine, 1,4-cyclohexane bis(methylamine), 1,3-cyclohexane bis(methylamine), diethylene glycol di(aminopropyl) ether, 2-methylpentamethylenediamine, diaminocyclohexane, diethylenetriamine, triethylenetetramine, tetraethylenepentamine, propylenediamine, 1,3-diaminopropane, dimethylaminopropylamine, diethylaminopropylamine, dipropylenetriamine, imidobis(propylamine), monoethanolamine, diethanolamine, triethanolamine, monoisopropanolamine, diisopropanolamine, isophoronediamine, 4,4'-methylenebis (2-chloroaniline), 3,5-dimethylthio-2,4-toluenediamine, 3,5-dimethylthio-2,6-toluenediamine, 3,5-diethylthio-2,4-toluenediamine, 3,5-diethylthio-2,6-toluenediamine, 4,4'-bis (sec-butylamino)diphenylmethane and derivatives thereof, 1,4-bis(sec-butylamino)benzene, 1,2-bis(sec-butylamino) benzene, N,N'-dialkylaminodiphenylmethane, N,N,N',N'-tetrakis(2-hydroxypropyl)ethylenediamine, trimethylene glycol di-p-aminobenzoate, polytetramethylene oxide di-p-aminobenzoate, 4,4'-methylenebis(3-chloro-2,6-diethyleneaniline), 4,4'-methylenebis(2,6-diethylaniline), m-phenylenediamine, p-phenylenediamine and mixtures thereof. These amine curing agents may be used singly or two or more may be used in combination.

(iii) Polyol

Although not an essential ingredient, in addition to the above-described components (i) and (ii), a polyol may also be included in the polyurea. The polyol is not particularly limited, but is preferably one that has hitherto been used in the art relating to polyurethanes. Specific examples include the long-chain polyols and/or polyol curing agents mentioned below.

The long-chain polyol may be any that has hitherto been used in the art relating to polyurethanes. Examples include, but are not limited to, polyester polyols, polyether polyols, polycarbonate polyols, polyester polycarbonate polyols, polyolefin-based polyols, conjugated diene polymer-based polyols, castor oil-based polyols, silicone-based polyols and vinyl polymer-based polyols. These long-chain polyols may be used singly or two or more may be used in combination.

The long-chain polyol has a number-average molecular weight of preferably from 1,000 to 5,000, and more preferably from 1,700 to 3,500. In this average molecular weight range, an even better resilience and productivity are obtained.

The polyol curing agent is preferably one that has hitherto been used in the art relating to polyurethanes, but is not subject to any particular limitation. In this invention, use may be made of a low-molecular-weight compound having on the molecule at least two active hydrogen atoms capable of reacting with isocyanate groups, and having a molecular weight of less than 1,000. Of these, the use of aliphatic diols having from 2 to 12 carbon atoms is preferred. Specific examples include 1,4-butylene glycol, 1,2-ethylene glycol, 1,3-butanediol, 1,6-hexanediol and 2,2-dimethyl-1,3-propanediol. The use of 1,4-butylene glycol is especially preferred. The polyol curing agent has a number-average molecular weight of preferably less than 800, and more preferably less than 600.

A known method may be used to produce the polyurea. A prepolymer process, a one-shot process or some other known method may be suitably selected for this purpose.

From the standpoint of the spin properties and scuff resistance obtained in the golf ball, component (A) has a material hardness on the Shore D scale which is preferably 65 or less, more preferably 60 or less, and even more preferably 55 or less. From the standpoint of moldability, the lower limit on the Shore D hardness scale is preferably 25 or more, and more preferably 30 or more.

Component (A) above is the base resin of the resin composition. In order to fully impart the scuff resistance of the urethane resin, component (A) accounts for at least 50 wt %, preferably at least 60 wt %, more preferably at least 70 wt %, even more preferably at least 80 wt %, and most preferably at least 90 wt %, of the resin composition.

In this invention, by blending component (B), which is described in detail below, into above component (A), the initial velocity of the ball on approach shots falls, as a result of which the contact time between the ball and the clubface at the time of impact increases and the ball does not fly excessively. Because this allows the ball to be hit hard, the ball is easier to control to the desired spin performance, enabling delicate controllability around the green. Moreover, the ball is able to retain a good scuff resistance without a loss of distance on shots with a driver.

The styrenic resin material of component (B) is exemplified by homopolymers of styrenic monomers such as styrene, α-methylstyrene, vinyltoluene, ethylstyrene, i-propylstyrene, t-butylstyrene, dimethylstyrene, bromostyrene and chlorostyrene; styrenic copolymers; and rubber-toughened styrene copolymers. Exemplary styrenic copolymers include polymers obtained by polymerizing one or more vinyl monomer, and copolymers obtained by copolymerizing one or more vinyl monomer with one or more monomer that is copolymerizable therewith. Exemplary rubber-toughened styrene copolymers include those having a structure in which a styrene monomer-containing copolymer is grafted onto a rubbery polymer, and those having a structure in which a styrene monomer-containing copolymer is not grafted onto a rubbery polymer. Examples of this rubbery polymer include conjugated diene rubber polymers such as polybutadiene, styrene-butadiene random or block copolymers, polyisoprene, polychloroprene, styrene-isoprene random, block or graft copolymers, ethylene-propylene rubbers, and ethylene-propylene-diene rubbers.

Examples of styrenic resin materials include styrenic polymers such as polystyrene (PS), rubber-toughened styrenic polymers such as general-purpose polystyrene resins (GPPS) and high-impact polystyrene resins (HIPS), styrenic copolymers such as acrylonitrile/styrene copolymers (AS), and rubber-toughened (co)polymers such as acrylonitrile/ethylene-propylene-nonconjugated diene rubber/styrene copolymers (AES), acrylonitrile/butadiene/styrene copolymers (ABS), methyl methacrylate/butadiene/styrene copolymers (MBS) and acrylonitrile/styrene/acrylic rubber copolymers (ASA). Of these, the use of HIPS or GPPS is preferred. In particular, from the standpoint of increasing flowability during molding and yet being able to exhibit a rebound-lowering effect on approach shots, the use of HIPS is most preferred. In addition to a styrenic monomer, HIPS contains rubber ingredients such as butadiene. Examples include copolymers in which the rubber ingredient is copolymerized with a styrenic monomer, and resin blends of such a copolymer with another homopolymer or copolymer. In general-purpose polystyrene resins (GPPS), the resin ingredients other than additives and the like consist substantially of styrene monomer.

In this invention, "styrenic resin material" also encompasses styrenic thermoplastic elastomers. Styrenic thermoplastic elastomers are block polymers which use polystyrene as the hard segments in the molecule, and use a polydiene such as polybutadiene or polyisoprene as the soft segments. Examples of styrenic thermoplastic elastomers include styrene-butadiene-styrene block copolymers (SBS) and styrene-isoprene-styrene block copolymers (SIS); styrene-ethylene/butadiene-styrene block copolymers (SEBS), styrene-ethylene/propylene-styrene block copolymers and styrene-ethylene/isoprene-styrene block copolymers (SEPS) obtained by the hydrogenation of these; and also hydrogenated polymers of random styrene-butadiene rubbers (HSBR), and mixtures of these with polypropylene.

Commercial products may be used as the styrenic resin material. Examples include DIC Styrene GPPS and DIC Styrene HIPS from DIC Corporation, RB 840 from JSR Corporation, Toyo Styrol GP and Toyo Styrol HI from Toyo Styrene Co., Ltd., PSJ Polystyrene GPPS and PSJ Polystyrene HIPS from PS Japan Corporation, EARNESTON from Kuraray Plastics Co., Ltd., and Tuftec and Tufprene from Asahi Kasei Corporation.

Component (B) has a Shore D hardness of preferably 90 or less, more preferably 85 or less, and even more preferably 80 or less.

Component (B) has a rebound resilience, as measured according to JIS-K 6255, of preferably 60% or less, more preferably 55% or less, even more preferably 50% or less, and most preferably 45% or less. By holding down the rebound resilience in this way, a reduction in the ball initial velocity on approach shots can be achieved at a small amount of addition without adversely affecting the golf ball properties. To minimize a decline in rebound and a reduction in distance on shots with a driver, the lower limit in the rebound resilience is preferably at least 20%.

Component (B) has a flexural modulus, as measured according to JIS-K 7171, of preferably not more than 3,500 MPa, more preferably not more than 3,400 MPa, even more preferably not more than 3,000 MPa, and most preferably not more than 2,600 MPa. By thus holding down the flexural modulus, the initial velocity of the ball on approach shots can be reduced without adversely affecting the golf ball properties. The lower limit in the flexural modulus is preferably at least 1,800 MPa.

The content of component (B) per 100 parts by weight of component (A) is preferably from 0.5 to 50 parts by weight. This content is more preferably from 1 to 25 parts by weight, and even more preferably from 2 to 10 parts by weight. When the content of component (B) is low, the ball initial velocity-lowering effect on approach shots decreases as well. Also, in this resin composition, because the urethane resin serving as component (A) is fully responsible for the scuff resistance properties, an excessive content of component (B) may result in a loss of scuff resistance.

Aside from above components (A) and (B), other resin materials may also be included in the golf ball resin composition of the invention. The purpose for doing so is, for example, to further improve the flowability of the golf ball resin composition and to increase various properties of the golf ball such as rebound and scuff resistance.

The other resin materials may be selected from among polyester elastomers, polyamide elastomers, ionomeric resins, ethylene-ethylene/butylene-ethylene block copolymers and modified forms thereof, polyacetals, polyethylenes, nylon resins, methacrylic resins, polyvinyl chlorides, polycarbonates, polyphenylene ethers, polyarylates, polysulfones, polyethersulfones, polyetherimides and polyamideimides. These may be used singly or two or more may be used together.

It is recommended that the base resin composed of components (A) and (B) be included in a combined amount which, although not particularly limited, is typically at least 60 wt %, preferably at least 70 wt %, more preferably at least 80 wt %, and most preferably at least 90 wt %, of the overall resin composition. When the amount included is inadequate, the desired effect of the invention may not be achieved.

Aside from above components (A) and (B), an isocyanate compound may additionally be included as component (C) in the cover-forming resin composition. The isocyanate compound, by reacting with the polyurethane or polyurea serving as component (A), can further increase the scuff resistance of the resin composition. Moreover, the plasticizing effect of the isocyanate can increase the flowability of the resin composition and improve the moldability.

Any isocyanate compound employed in conventional polyurethanes may be used without particular limitation as the isocyanate compound (C). For example, aromatic isocyanate compounds that may be used include 2,4-toluene diisocyanate, 2,6-toluene diisocyanate and mixtures of both, 4,4-diphenylmethane diisocyanate, m-phenylene diisocyanate and 4,4'-biphenyl diisocyanate. Use can also be made of the hydrogenated forms of these aromatic isocyanate compounds, such as dicyclohexylmethane diisocyanate. Other isocyanate compounds that may be used include aliphatic diisocyanates such as tetramethylene diisocyanate, hexamethylene diisocyanate (HDI) and octamethylene diisocyanate; and alicyclic diisocyanates such as xylene diisocyanate. Further examples of isocyanate compounds that may be used include blocked isocyanate compounds obtained by reacting the isocyanate groups on a compound having two or more isocyanate groups on the ends with a compound having active hydrogens, and uretdiones obtained by isocyanate dimerization.

The amount of the isocyanate compound (C) included per 100 parts by weight of component (A) is preferably at least 0.1 part by weight, and more preferably at least 0.5 part by weight. The upper limit is preferably not more than 30 parts by weight, and more preferably not more than 20 parts by weight. When too little is included, sufficient crosslinking reactions may not be obtained and an increase in the properties may not be observable. On the other hand, when too much is included, discoloration over time or due to heat and ultraviolet light may increase, or problems may arise such as a loss of thermoplasticity or a decline in resilience.

In addition, depending on the intended use, optional additives may be suitably included in the resin composition. For example, when the golf ball resin composition of the invention is to be used as a cover material, various types of additives, such as inorganic fillers, organic staple fibers, reinforcing agents, crosslinking agents, pigments, dispersants, antioxidants, ultraviolet absorbers and light stabilizers, may be added to the foregoing ingredients. When such additives are included, the amount thereof, per 100 parts by weight of the base resin, is preferably at least 0.1 part by weight, and more preferably at least 0.5 part by weight, but preferably not more than 10 parts by weight, and more preferably not more than 4 parts by weight.

The mixture of components (A) and (B) may be carried out by, for example, mixture using any of various types of mixers, such as a kneading-type single-screw or twin-screw extruder, a Banbury mixer, a kneader or a Labo Plastomill. Alternatively, both of these ingredients may be mixed together by dry blending at the time that the resin composition is to be injection molded. In addition, when component (C) is used, it may be incorporated at the time of resin mixture using various types of mixers, or a masterbatch already containing components (B) and (C) may be separately prepared and components (A) to (C) mixed together by dry blending at the time that the resin composition is to be injection molded.

The method of molding the cover may entail, for example, feeding the above-described resin composition to an injection molding machine and injecting the molten resin composition over the core. In this case, the molding temperature varies depending on the type of polyurethane, polyurea or the like serving as component (A), but is generally in the range of 150° C. to 270° C.

With regard to the hardnesses at given positions in the cover, the cover has a Martens hardness (Hm), as measured at a position 0.2 mm toward the center of the ball from the surface of the cover, which is preferably 25 $N/mm^2$ or less, and more preferably 20 $N/mm^2$ or less. The lower limit is preferably 10 $N/mm^2$ or more. The reason is that, at a Martens hardness of 25 $N/mm^2$ or less, an optimal spin rate is achieved on approach shots and a soft feel at impact is obtained.

The Martens hardness can be measured with a nanohardness tester based on ISO 14577: 2002 ("Metallic materials—Instrumented indentation test for hardness and materials parameters"). This is a physical value determined by pressing an indenter against the object being measured while applying a load to the indenter, and is calculated as (test load)/(surface area of indenter under test load) in $N/mm^2$ units. Measurement of the Martens hardness may be carried out using, for example, the nanohardness tester available from Fischer Instruments under the product name Fischerscope HM2000. This instrument can, for example, use a Vickers indenter to measure the hardness of the cover while successively increasing the load in a stepwise manner. The nanohardness test conditions may be set to room temperature, 10 seconds, and an applied load of 50 mN.

When measuring the surface of the cover, because a coating film or the like has been formed on the cover surface, it is difficult to specify the surface hardness. However, the Martens hardness inherent to the cover can be reliably obtained at a position 0.2 mm from the cover surface toward the center of the ball.

At least one intermediate layer may be interposed between the core and the cover. In this case, it is preferable to employ as the intermediate layer material any of the various types of thermoplastic resins used in golf ball cover stock, especially an ionomer resin. A commercial product may be used as the ionomer resin. Of commercially available ionomer resins, a high-acid ionomer resin having an acid content of at least 16 wt % can be blended into an ordinary ionomer resin and used as the resin material of the intermediate layer. With such a blend, a good distance on shots with a driver (W #1) can be obtained on account of the high resilience and the reduced spin rate. The content of unsaturated carboxylic acid included in such a high-acid ionomer resin (acid content) is generally at least 16 wt %, preferably at least 17 wt %, and more preferably at least 18 wt %. The upper limit is preferably not more than 22 wt %, more preferably not more than 21 wt %, and even more preferably not more than 20 wt %.

It is desirable to abrade the surface of the intermediate layer in order to increase adhesion of the intermediate layer material with the polyurethane-based resin composition that is preferably used in the cover material. In addition, following such abrasion treatment, it is desirable to apply a primer (adhesive) to the surface of the intermediate layer or to add an adhesion reinforcing agent to the material.

The material hardness of the intermediate layer, expressed in terms of Shore D hardness, is preferably at least 61, more preferably at least 62, and even more preferably at least 63. The upper limit is preferably not more than 72, more preferably not more than 70, and even more preferably not more than 68. At a material hardness lower than this range, the rebound on full shots with a driver (W #1) or an iron may be inadequate or the ball may be too receptive to spin, as a result of which a good distance may not be achieved. On the other hand, at a material hardness higher than this range, the durability to cracking on repeated impact may worsen or the feel at impact may become too hard.

The intermediate layer has a thickness of preferably at least 0.8 mm, more preferably at least 1.0 mm, and still more preferably at least 1.1 mm. The upper limit is preferably not more than 1.7 mm, and more preferably not more than 1.5 mm. Outside of this range, the spin rate-lowering effect on shots with a driver (W #1) may be inadequate and a good distance may not be achieved.

Numerous dimples may be formed on the outside surface of the cover serving as the outermost layer. The number of dimples arranged on the cover surface, although not particularly limited, is preferably at least 250, more preferably at least 300, and even more preferably at least 320. The upper limit is preferably not more than 380, more preferably not more than 350, and even more preferably not more than 340. When the number of dimples is higher than this range, the ball trajectory may become lower, as a result of which the distance traveled by the ball may decrease. Conversely, when the number of dimples is lower that this range, the ball trajectory may become higher, as a result of which a good distance may not be achieved.

The dimple shapes used may be of one type or may be a combination of two or more types suitably selected from among, for example, circular shapes, various polygonal shapes, dewdrop shapes and oval shapes. When circular dimples are used, the dimple diameter may be set to at least about 2.5 mm and up to about 6.5 mm, and the dimple depth may be set to at least 0.08 mm and up to 0.30 mm.

In order for the aerodynamic properties to be fully manifested, it is desirable for the dimple coverage ratio on the spherical surface of the golf ball, i.e., the dimple surface coverage SR, which is the sum of the individual dimple surface areas, each defined by the flat plane circumscribed by the edge of a dimple, as a percentage of the spherical surface area of the ball were the ball to have no dimples thereon, to be set to at least 70% and not more than 90%. Also, to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and not more than 0.80. Moreover, it is preferable for the ratio VR of the sum of the volumes of the individual dimples, each formed below the flat plane circumscribed by the edge of a dimple, with respect to the volume of the ball sphere were the ball surface to have no dimples thereon, to be set to at least 0.6% and not more than 1.0%. Outside of the above ranges in these respective values, the resulting trajectory may not enable a good distance to be obtained and so the ball may fail to travel a fully satisfactory distance.

Figure 2:
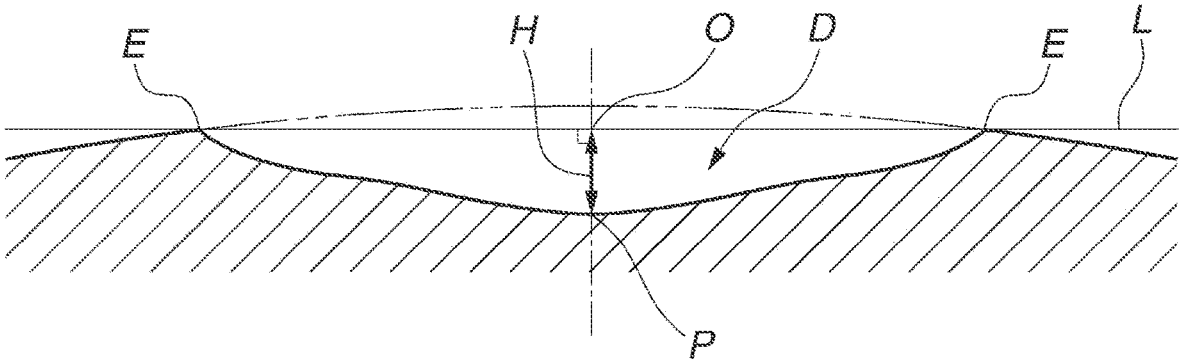
FIG. 2 is a schematic cross-sectional diagram of a dimple having a distinctive cross-sectional shape.

In addition, by optimizing the cross-sectional shape of the dimples, the variability in the flight of the ball can be reduced and the aerodynamic performance improved. Moreover, by holding the percentage change in depth at given positions in the dimples within a fixed range, the dimple effect can be stabilized and the aerodynamic performance improved. The ball has arranged thereon at least one dimple with the cross-sectional shape described below. This is exemplified by dimples having distinctive cross-sectional shapes like that shown in FIG. 2. FIG. 2 is an enlarged cross-sectional view of a dimple that is circular as seen from above. In this diagram, the symbol D represents a dimple, E represents an edge of the dimple, P represents a deepest point of the dimple, the straight line L is a reference line which passes through the dimple edge E and a center O of the dimple, and the dashed line represents an imaginary spherical surface. The foot of a perpendicular drawn from the deepest point P of the dimple D to an imaginary plane defined by the peripheral edge of the dimple D coincides with the dimple center O. The dimple edge E serves as the boundary between the dimple D and regions (lands) on the ball surface where dimples D are not formed, and corresponds to points where the imaginary spherical surface is tangent to the ball surface (the same applies below). The dimples D generally are circular dimples as seen from above; i.e., in a plan view. The center O of the dimple in each plan view coincides with the deepest point P.

The cross-sectional shape of the dimple D must satisfy the following conditions.

First, as condition (i), let the foot of a perpendicular drawn from a deepest point P of the dimple to an imaginary plane defined by a peripheral edge of the dimple be the dimple center O, and let a straight line that passes through the dimple center O and any one point on the edge E of the dimple be the reference line L.

Next, as condition (ii), divide a segment of the reference line L from the dimple edge E to the dimple center O into at least 100 points. Then compute the distance ratio for each point when the distance from the dimple edge E to the dimple center O is set to 100%. The dimple edge E is the origin, which is the 0% position on the reference line L, and the dimple center O is the 100% position with respect to segment EO on the reference line L.

Next, as condition (iii), compute the dimple depth ratio at every 20% from 0 to 100% of the distance from the dimple edge E to the dimple center O. In this case, the dimple center O is at the deepest part P of the dimple and has a depth H (mm). Letting this be 100% of the depth, the dimple depth ratio at each distance is determined. The dimple depth ratio at the dimple edge E is 0%.

Next, as condition (iv), at the depth ratios in dimple regions 20 to 100% of the distance from the dimple edge E to the dimple center O, determine the change in depth ΔH every 20% of the distance and design a dimple cross-sectional shape such that the change ΔH is at least 6% and not more than 24% in all regions corresponding to from 20 to 100% of the distance.

In this invention, by quantifying the cross-sectional shape of the dimple in this way, that is, by setting the change in dimple depth ΔH to at least 6% and not more than 24%, and thereby optimizing the dimple cross-sectional shape, the flight variability decreases, enhancing the aerodynamic performance of the ball. This change ΔH is preferably from 8 to 22%, and more preferably from 10 to 20%.

Also, to further increase the advantageous effects of the invention, in dimples having the above specific cross-sectional shape, it is preferable for the change in dimple depth ΔH to reach a maximum at 20% of the distance from the dimple edge E to the dimple center O. Moreover, it is preferable for two or more points of inflection to be included on the curved line describing the cross-sectional shape of the dimple having the above specific cross-sectional shape.

Various types of coatings may be applied to the surface of the cover. Because the coating must be capable of enduring the harsh conditions of golf ball use, a two-part curable urethane coating, especially a non-yellowing urethane coating, is preferred.

The golf ball of the invention is characterized by having an incident velocity and a rebound velocity, as measured when the ball is dropped from a height of 3 m, which satisfy formula (1) below $$(\text{incident velocity})-(\text{rebound velocity})\geq 0.80\ \text{m/s} \quad (1).$$

Figure 3:
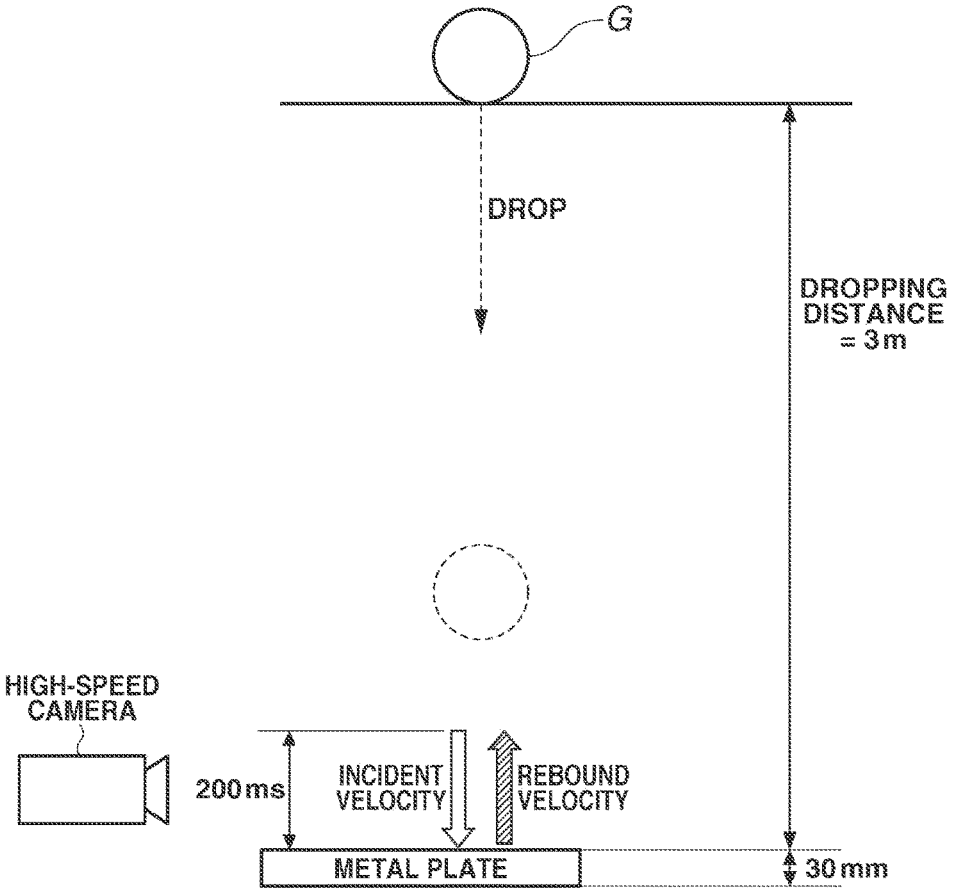
FIG. 3 is a schematic diagram illustrating a test for measuring the incident and rebound velocities of a golf ball that is dropped and made to collide with a metal plate.

This drop test is a test in which, as shown in FIG. 3, the golf ball G being tested is allowed to fall freely from a height of 3 m and thereby made to drop onto and collide with a metal plate. The metal plate that the ball is made to strike is a stainless steel plate having a thickness of 30 mm, and the incident velocity is the average velocity 200 ms (20,000 frames) before the onset of the collision between the dropped golf ball and the metal plate. The rebound velocity is the average velocity 200 ms (20,000 frames) from the instant at which the metal plate and the golf ball separate. The incident and rebound velocities were determined by, as shown in the image in FIG. 4, placing dot marks within the dimples on the golf ball and calculating the velocities from the amount of movement in the dots per frame. The high-speed camera used for this purpose was the FASTCAM SA-X2 from Photron, Ltd.; the recording speed was 100,000 frames per second (fps), and the number of pixels was 640×488. As shown in FIG. 3, the imaging position of the high-speed camera was set in such a way as to be able to capture the ball 200 ms before and after collision with the metal plate.

The incident velocity of the golf ball in the drop test is 7.90 m/s or less, the rebound velocity is preferably 7.00 m/s or less, more preferably 6.80 m/s or less, and even more preferably 6.60 m/s or less.

The value in formula (1) is preferably at least 0.80 m/s, more preferably at least 0.81 m/s, and even more preferably at least 0.82 m/s. When this value is 0.80 m/s or more, the initial velocity of the ball on approach shots is not rapid and the shot velocity can be held down, enabling the ball to be accurately hit with respect to the target. Also, to reliably achieve the target distance, the ball needs to be struck at a higher head speed than other balls. Hence, the spin rate also inevitably rises, producing the effect of a higher overall controllability.

The golf ball of the invention, when struck at a head speed (HS) of 21 m/s with a wedge that has a loft angle of 58° and is mounted on a shot robot made by Miyamae Co., Ltd. has a relationship between the head speed (HS) and the ball initial velocity (IV) which is preferably such that HS−IV≥0.26 m/s. This value is more preferably at least 0.28 m/s. The shot velocity can thereby be held down, enabling the ball to be more accurately hit with respect to the target. Also, to reliably obtain the target distance, the ball needs to be struck at a higher head speed than other balls. Hence, the spin rate also inevitably rises, producing the effect of a higher overall controllability.

The multi-piece solid golf ball of the invention can be made to conform to the Rules of Golf for play. The inventive ball may be formed to a diameter which is such that the ball does not pass through a ring having an inner diameter of 42.672 mm and is not more than 42.80 mm, and to a weight which is preferably between 45.0 and 45.93 g.

EXAMPLES

The following Examples and Comparative Examples are provided to illustrate the invention, and are not intended to limit the scope thereof.

Examples 1 to 4, Comparative Examples 1 and 2

Using the blend of ingredients shown in Table 1, cores of given diameters (see Table 3) were produced by preparing rubber core compositions in each of Examples 1 to 4 and Comparative Examples 1 and 2, and molding and vulcanizing the compositions.

TABLE 1

| | | Example | | | | Comparative Example | |
|---|---|---|---|---|---|---|---|
| Ingredients (pbw) | | 1 | 2 | 3 | 4 | 1 | 2 |
| Polybutadiene A | | 80 | 80 | 80 | 80 | 80 | 70 |
| Polybutadiene B | | 20 | 20 | 20 | 20 | 20 | 30 |
| Unsaturated metal carboxylate | | 39.7 | 39.7 | 39.7 | 39.7 | 39.7 | 24.3 |
| Organic peroxide (1) | | 1.0 | 1.0 | 1.0 | 1.0 | 1.0 | 0.6 |
| Organic peroxide (2) | | | | | | | 0.6 |
| Antioxidant | | 0.1 | 0.1 | 0.1 | 0.1 | 0.1 | 0.1 |
| Zinc oxide | | 13.6 | 13.6 | 13.6 | 13.6 | 13.6 | 29.1 |
| Zinc salt of pentachlorothiophenol | | 0.5 | 0.5 | 0.5 | 0.5 | 0.5 | 0.2 |
| Zinc stearate | | | | | | | 1.0 |
| Water | | 0.9 | 0.9 | 0.9 | 0.9 | 0.9 | |
| Vulcanization conditions | Temperature (° C.) | 152 | 152 | 152 | 152 | 152 | 155 |
| | Time (min) | 19 | 19 | 19 | 19 | 19 | 13 |

Details on the above core materials are given below.

Polybutadiene A: Available under the trade name "BR01" from JSR Corporation

Polybutadiene B: Available under the trade name "BR51" from JSR Corporation

Unsaturated metal carboxylate: Zinc acrylate (from Wako Pure Chemical Industries., Ltd.)

Organic peroxide (1): Dicumyl peroxide, available under the trade name "Percumyl D" from NOF Corporation Organic peroxide (2): A mixture of 1,1-di(tert-butylperoxy) cyclohexane and silica, available under the trade name "Perhexa C-40" from NOF Corporation Antioxidant: 2,6-Di-t-butyl-4-methylphenol, available under the trade name "Nocrac SP-N" from Ouchi Shinko Chemical Industry Co., Ltd.

Zinc oxide: Available under the trade name "Grade No. 3 Zinc Oxide" from Sakai Chemical Co., Ltd.

Zinc salt of pentachlorothiophenol: Available from Wako Pure Chemical Industries, Ltd.

Zinc stearate: Available under the trade name "Zinc Stearate G" from NOF Corporation Water: Distilled water (from Wako Pure Chemical Industries, Ltd.)

Next, an intermediate layer-encased sphere having an intermediate layer of a given thickness (see Table 3) was produced by injection-molding intermediate layer-forming resin composition No. 1 or No. 2 shown in Table 2 over the core obtained as described above.

Cover materials No. 3 to No. 8 shown in Table 2 were then injection-molded over the intermediate layer-encased spheres, thereby producing three-piece golf balls having a cover (outermost layer) of a given thickness (see Table 3). Dimples common to all the Examples were formed at this time on the surface of the cover in the respective Examples and Comparative Examples.

TABLE 2

| Ingredients (pbw) | Acid content (wt %) | No. 1 | No. 2 | No. 3 | No. 4 | No. 5 | No. 6 | No. 7 | No. 8 |
|---|---|---|---|---|---|---|---|---|---|
| AM7318 | 18 | 70 | | | | | | | |
| AM7329 | 15 | 15 | | | | | | | 15 |
| Himilan 1706 | 15 | 15 | | | | | | | |
| Himilan 1605 | 15 | | | | | | | | 50 |
| Surlyn 9320 | 10 | | | | | | | | 35 |
| HPF 2000 | 15 | | 100 | | | | | | |
| T-8283: component (A) | | | | 100 | 100 | 100 | 100 | 100 | |
| HIPS: component (B) | | | | 3 | 10 | | | | |
| SEBS: component (B) | | | | | | 5 | 15 | | |
| Silicone wax | | | | 0.5 | 0.5 | 0.5 | 0.5 | 0.5 | |
| Polyethylene wax | | | | 1.0 | 1.0 | 1.0 | 1.0 | 1.0 | |
| Isocyanate compound | | | | 6.3 | 6.3 | 6.3 | 6.3 | 6.3 | |
| Titanium oxide | | | | 3.3 | 3.3 | 3.3 | 3.3 | 3.3 | |
| Trimethylolpropane (TMP) | | 1.1 | | | | | | | |

Trade names for the chief materials mentioned in the table are given below.

AM7318, AM7329, Himilan 1706, Himilan 1605: Ionomers available from DuPont-Mitsui Polychemicals Co., Ltd.

Surlyn 9320: A zinc-neutralized ionomer available from E.I. DuPont de Nemours & Co.

HPF 2000: HPF™ 2000, from E.I. DuPont de Nemours & Co.

T-8283: An MDI-PTMG-type thermoplastic polyurethane available from DIC Covestro Polymer, Ltd.

HIPS: An impact-resistant polystyrene resin available from DIC Corporation under the trade name "DIC Styrene MH-6800-1"

SEBS: A styrenic block copolymer available from Kuraray Co., Ltd.

Polyethylene wax: Available under the product name "Sanwax 161P" from Sanyo Chemical Industries, Ltd.

Isocyanate compound: 4,4'-Diphenylmethane diisocyanate

The ball diameter, ball deflection, initial velocity on shots with a driver and Martens hardness of the golf balls obtained in the respective Examples and Comparative Examples were measured as described below. The results are shown in Table 3.

Ball Diameter

The diameters at 15 random dimple-free areas on the surface of a ball were measured at a temperature of 23.9±1° C. and, using the average of these measurements as the measured value for a single ball, the average diameter for five measured balls was determined.

Ball Deflection

A ball was placed on a hard plate and the amount of deflection (mm) when compressed under a final load of 1,275 N (130 kgf) from an initial load of 98 N (10 kgf) was measured. The amount of deflection here refers in each case to the measured value obtained after holding the ball isothermally at 23.9° C.

Martens Hardness

The golf ball in each Example was cut in half, a position situated 0.2 mm toward the ball center from the cover surface was selected in the ball cross-section, and the Martens hardness (Hm) at that position was measured using the nanohardness tester available under the trade name Fischerscope HM2000 from Fischer Instruments. The hardness measurements were carried out at room temperature and under an applied load of 50 mN/10 s.

In addition, a drop test and an impact test were carried out as follows on the golf balls in each Example. The controllability of the ball on approach shots was evaluated as described below. The results are shown in Table 3.

Drop Test

As shown in FIG. 3, the velocity difference of the golf ball in each Example when dropped from a height of 3 m and made to strike a metal plate was measured using a drop tester. In the drop test, the manner in which the ball rebounds when dropped onto the metal plate was captured with a high-speed camera. Dropping of the ball takes place as follows: at room temperature (23 to 24° C.) and while the ball is held by a chuck, an air hose connected to the chuck is actuated and releases air, causing the ball to separate from the chuck and fall.

The high-speed camera was the FASTCAM SA-X2 from Photron, Ltd., which had a recording speed of 100,000 fps, a 24-mm lens and produced 640×488 pixel images. The metal plate used was a stainless steel plate having a thickness of 30 mm. The incident velocity was taken as the average velocity from 200 ms prior to the collision up to onset of the collision, and the rebound velocity was taken as the average velocity from the instant the ball separates from the plate up to 200 ms thereafter. Here, "ms" represents 1/1000 of a second, and the high-speed camera captures 100,000 frames per second. Given that 0.2 second of imaging is carried out in the 200 ms before and in the 200 ms after the collision, 20,000 frames are captured during each of these intervals.

Evaluation Criteria:

An (incident velocity)−(rebound velocity) value of 0.80 m/s or more was rated as "Good."

An (incident velocity)−(rebound velocity) value of less than 0.80 m/s was rated as "NG."

Figure 4:
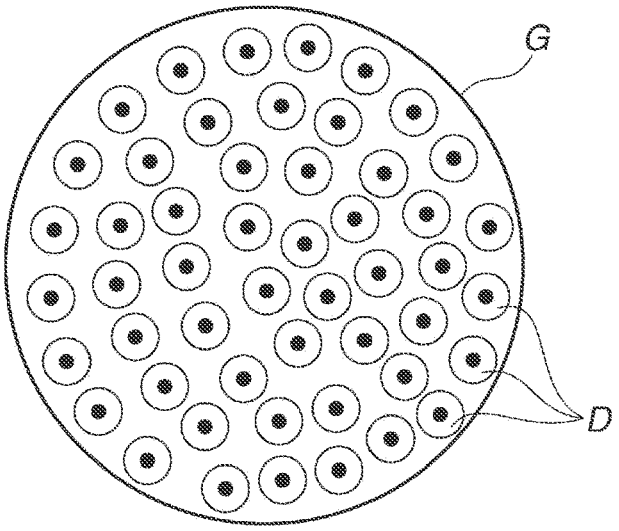
FIG. 4 is a schematic top view showing a golf ball in which the centers of the dimples on the ball surface have been marked with small dots for velocity measurement in the test illustrated in FIG. 3.

For these respective velocities, as shown in FIG. 4, the center of each dimple D on the surface of the ball G was marked with a small dot, and the velocities were calculated from the amount of movement by the dots per frame.

Impact Test

The velocity difference between the ball initial velocity and the club head speed (HS=21 m/s) when the ball is struck with a wedge having a loft angle of 58° and mounted on a shot robot made by Miyamae Co., Ltd. was measured. The club used was the "TourB XW-1" (SW) from Bridgestone Sports Co., Ltd. A velocity difference of 0.26 m/s or more was rated as "Good"; a velocity difference of less than 0.26 m/s was rated as "NG."

Controllability

The controllability was rated as "Good" when six or more out of ten golfers who took actual shots with the golf balls produced in each Example responded that the controllability was high, and was rated as "NG" when fewer than six golfers responded in this way. The clubs used were the golfers' own clubs. The controllability on approach shots taken from 40 yards out was evaluated.

TABLE 3

| | | Example | | | | Comparative Example | |
|---|---|---|---|---|---|---|---|
| | | 1 | 2 | 3 | 4 | 1 | 2 |
| | Ball construction | 3-piece | 3-piece | 3-piece | 3-piece | 3-piece | 3-piece |
| Core | Material | rubber | rubber | rubber | rubber | rubber | rubber |
| | Diameter (mm) | 38.45 | 38.45 | 38.45 | 38.45 | 38.45 | 37.30 |
| | Weight (g) | 34.6 | 34.6 | 34.6 | 34.6 | 34.6 | 32.6 |
| | 10-130 kg hardness (mm) | 3.6 | 3.6 | 3.6 | 3.6 | 3.6 | 4.3 |
| Intermediate layer | Material | No. 1 | No. 1 | No. 1 | No. 1 | No. 1 | No. 2 |
| | Thickness (g) | 1.30 | 1.30 | 1.30 | 1.30 | 1.30 | 1.35 |
| | Material hardness (Shore D) | 65 | 65 | 65 | 65 | 65 | 48 |
| | Acid content (wt %) | 17 | 17 | 17 | 17 | 17 | 15 |
| Cover | Material | No. 3 | No. 4 | No. 5 | No. 6 | No. 7 | No. 8 |
| | Thickness (mm) | 0.82 | 0.82 | 0.82 | 0.82 | 0.82 | 1.34 |
| | Material hardness (Shore D) | 45 | 47 | 43 | 41 | 43 | 59 |
| Ball | Diameter (mm) | 42.7 | 42.7 | 42.7 | 42.7 | 42.7 | 42.7 |
| | Weight (g) | 45.4 | 45.4 | 45.4 | 45.4 | 45.4 | 45.4 |
| | 10-130 kg hardness (mm) | 2.8 | 2.7 | 2.7 | 2.7 | 2.8 | 3.7 |
| | Initial velocity (m/s) | 77.1 | 77.1 | 77.1 | 77.1 | 77.1 | 77.1 |
| | Martens hardness ($N/mm^2$) | 20 | 23 | 15 | 12 | 15 | 46 |
| Drop test | Incident velocity (m/s) | 7.37 | 7.37 | 7.37 | 7.37 | 7.37 | 7.37 |
| | Rebound velocity (m/s) | 6.56 | 6.54 | 6.56 | 6.53 | 6.58 | 6.60 |
| | Velocity difference (m/s) | 0.81 | 0.83 | 0.80 | 0.84 | 0.78 | 0.77 |
| | Rating | Good | Good | Good | Good | NG | NG |
| Impact test | Spin rate (rpm) | 6,284 | 6,158 | 6,249 | 6,122 | 6,312 | 5,012 |
| | Head speed HS (m/s) | 21.00 | 21.00 | 21.00 | 21.00 | 21.00 | 21.00 |
| | Initial velocity (m/s) | 20.68 | 20.63 | 20.70 | 20.61 | 20.75 | 20.79 |
| | Velocity difference (m/s) | 0.32 | 0.37 | 0.30 | 0.39 | 0.25 | 0.21 |
| | Rating | Good | Good | Good | Good | NG | NG |
| Sensory evaluations | Number of golfers who responded that controllability was high | 7 | 8 | 7 | 8 | 5 | 1 |
| | Rating | Good | Good | Good | Good | NG | NG |

As is apparent from the results in Table 3 above, the golf balls in Examples 1 to 4 had velocity differences in the drop test, defined as (incident velocity)−(rebound velocity), of 0.80 m/s or more. As a result, good ratings were obtained for the controllability on approach shots. By contrast, the golf balls in Comparative Examples 1 and 2 had velocity differences in the drop test of respectively 0.78 m/s and 0.77 m/s. As a result, the controllability on approach shots was poor.

Japanese Patent Application No. 2018-229979 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a core and a cover, wherein the cover is formed of a resin composition comprising (A) a polyurethane or a polyurea and (B) a styrenic resin material, and the ball, when dropped from a height of 3 m and made to collide with a metal plate, has velocities 200 ms before and 200 ms after contact that satisfy formula (1) below $$\text{(incident velocity)}-\text{(rebound velocity)} \geq 0.80 \text{ m/s} \quad (1),$$

wherein the cover has a plurality of dimples formed on a surface thereof, the ball has arranged thereon at least one dimple with a cross-sectional shape that is described by a curved line or a combination of straight and curved lines and specified by steps (i) to (iv) below, and the total number of dimples is from 250 to 380;

(i) letting the foot of a perpendicular drawn from a deepest point of the dimple to an imaginary plane defined by a peripheral edge of the dimple be the dimple center and a straight line that passes through the dimple center and any one point on the edge of the dimple be the reference line;

(ii) dividing a segment of the reference line from the dimple edge to the dimple center into at least 100 points and computing the distance ratio for each point when the distance from the dimple edge to the dimple center is set to 100%;

(iii) computing the dimple depth ratio at every 20% from 0 to 100% of the distance from the dimple edge to the dimple center; and (iv) at the depth ratios in dimple regions 20 to 100% of the distance from the dimple edge to the dimple center, determining the change in depth ΔH every 20% of said distance and designing a dimple cross-sectional shape such that the change ΔH is at least 6% and not more than 24% in all regions corresponding to from 20 to 100% of said distance.

2. The golf ball of claim 1, wherein the resin composition of the cover has a component (B) content of from 0.5 to 50 parts by weight per 100 parts by weight of component (A).

3. The golf ball of claim 1, wherein component (B) is one or more selected from the group consisting of polystyrene (PS), general-purpose polystyrene resins (GPPS), high-impact polystyrene resins (HIPS), styrene-isoprene-styrene block copolymers (SIS), styrene-butadiene-styrene block copolymers (SBS), styrene-ethylene/butadiene-styrene block copolymers (SEBS), styrene-ethylene/isoprene-styrene block copolymers (SEPS), acrylonitrile/styrene copolymers (AS), acrylonitrile/ethylene-propylene-nonconjugated diene rubber/styrene copolymers (AES), acrylonitrile/butadiene/styrene copolymers (ABS), methyl methacrylate/ butadiene/styrene copolymers (MBS) and acrylonitrile/styrene/acrylic rubber copolymers (ASA).

4. The golf ball of claim 3, wherein component (B) is a high-impact polystyrene resin (HIPS).

5. The golf ball of claim 1 wherein, when the ball is struck at a head speed (HS) of 21 m/s using a wedge with a loft angle of 58° that is mounted on a shot robot made by Miyamae Co., Ltd., the relationship between the head speed (HS) and the ball initial velocity (IV) satisfies the condition $$HS-IV \geq 0.26 \text{ (m/s)}.$$

6. The golf ball of claim 1, wherein the cover has a Martens hardness (Hm), as measured at a position 0.2 mm toward a center of the ball from a surface of the cover, which is 25 $N/mm^2$ or less.

7. The golf ball of claim 6, wherein the Martens hardness (Hm) is from 10 to 20 $N/mm^2$.

8. The golf ball of claim 1, wherein the ball has at least one intermediate layer interposed between the core and the cover, which intermediate layer is made of a material that includes a high-acid ionomeric resin having an acid content of at least 16 wt %.

* * * * *